US012796735B2

(12) United States Patent
Chen et al.

(10) Patent No.: US 12,796,735 B2
(45) Date of Patent: Nov. 17, 2026

(54) DELIVERY SYSTEM

(71) Applicant: Nicoventures Trading Limited, London (GB)

(72) Inventors: Ping Chou Chen, London (GB); Tom Woodman, London (GB); Sam Lai, London (GB)

(73) Assignee: NICOVENTURES TRADING LIMITED, London (GB)

( * ) Notice: Subject to any disclaimer, the term of this patent is extended or adjusted under 35 U.S.C. 154(b) by 711 days.

(21) Appl. No.: 17/923,025

(22) PCT Filed: May 11, 2021

(86) PCT No.: PCT/GB2021/051126

§ 371 (c)(1),
(2) Date: Nov. 3, 2022

(87) PCT Pub. No.: WO2021/240131

PCT Pub. Date: Dec. 2, 2021

(65) Prior Publication Data

US 2023/0157357 A1 May 25, 2023

(30) Foreign Application Priority Data

May 29, 2020 (GB) ..... 2008130

(51) Int. Cl.

| | |
|---|---|
| ***A24F 40/40*** | (2020.01) |
| ***A24F 40/60*** | (2020.01) |
| ***A24F 40/90*** | (2020.01) |

(52) U.S. Cl.
CPC ..... *A24F 40/40* (2020.01); *A24F 40/60* (2020.01); *A24F 40/90* (2020.01)

(58) Field of Classification Search
None
See application file for complete search history.

(56) References Cited

U.S. PATENT DOCUMENTS

| | | | | |
|---|---|---|---|---|
| 10,070,544 | B2 | 9/2018 | Beer | |
| 10,285,449 | B2 | 5/2019 | Murison | |
| 2001/0021098 | A1* | 9/2001 | Kambayashi | G06F 1/1688 361/679.09 |

(Continued)

FOREIGN PATENT DOCUMENTS

| | | | |
|---|---|---|---|
| CN | 101390659 | A | 3/2009 |
| CN | 102266125 | A | 12/2011 |

(Continued)

OTHER PUBLICATIONS

International Search Report for corresponding application PCT/GB2021/051122 filed May 11, 2021; Mail date Jul. 21, 2021.

(Continued)

*Primary Examiner* — Katelyn W Smith
(74) *Attorney, Agent, or Firm* — CANTOR COLBURN LLP

(57) ABSTRACT

A delivery device is disclosed and comprises a housing, a vibration motor for generating haptic feedback to a user, and an elastomeric support member received in the housing. The vibration motor is mounted within the support member. An assembly for insertion into a housing of a delivery device is also disclosed.

15 Claims, 4 Drawing Sheets

(56) References Cited

U.S. PATENT DOCUMENTS

| | | | | |
|---|---|---|---|---|
| 2009/0283103 | A1* | 11/2009 | Nielsen | A24F 40/60 131/273 |
| 2013/0164567 | A1 | 6/2013 | Olsson | |
| 2016/0198771 | A1 | 7/2016 | Goggin | |
| 2016/0213866 | A1 | 7/2016 | Tan | |
| 2016/0286858 | A1 | 10/2016 | Liu | |
| 2017/0238617 | A1 | 8/2017 | Scatterday | |
| 2017/0332701 | A1 | 11/2017 | Fornarelli | |
| 2018/0007393 | A1* | 1/2018 | Von Novak | H04N 21/632 |
| 2019/0021400 | A1* | 1/2019 | Fornarelli | A24F 40/60 |
| 2019/0124983 | A1* | 5/2019 | Rogers | A24F 40/485 |
| 2020/0008479 | A1* | 1/2020 | Ouyang | G01L 9/0041 |
| 2020/0113242 | A1 | 4/2020 | Novak | |
| 2020/0154789 | A1 | 5/2020 | Novak | |
| 2020/0178616 | A1* | 6/2020 | Yu | A24F 40/53 |
| 2021/0178090 | A1* | 6/2021 | Lahoud | A61M 15/0085 |
| 2022/0061399 | A1* | 3/2022 | Ferrie | H02J 7/0047 |

FOREIGN PATENT DOCUMENTS

| | | | | |
|---|---|---|---|---|
| EP | 3479585 | A1 | 5/2019 | |
| EP | 3590368 | A1 | 1/2020 | |
| EP | 3607985 | A1 | 2/2020 | |
| EP | 3479858 | B1 * | 8/2020 | A24F 40/485 |
| JP | 2000122793 | A | 4/2000 | |
| WO | 2020001252 | A1 | 1/2020 | |
| WO | 2020104880 | A1 | 5/2020 | |

OTHER PUBLICATIONS

International Search Report for corresponding application PCT/GB2021/051126 filed May 11, 2021; Mail date Jul. 23, 2021.

International Search Report for corresponding application PCT/GB2021/051316 filed May 28, 2021; Mail date Aug. 9, 2021.

Written Opinion for corresponding application PCT/GB2021/051122 filed May 11, 2021; Mail date Jul. 21, 2021.

Written Opinion for corresponding application PCT/GB2021/051126 filed May 11, 2021; Mail date Jul. 23, 2021.

Written Opinion for corresponding application PCT/GB2021/051316 filed May 28, 2021; Mail date Aug. 9, 2021.

* cited by examiner

DELIVERY SYSTEM

TECHNICAL FIELD

The present specification relates to a delivery system, such as a non-combustible aerosol provision system, or an aerosol-free delivery system.

BACKGROUND

Smoking articles, such as cigarettes, cigars and the like burn tobacco during use to create tobacco smoke. Attempts have been made to provide alternative delivery systems to these articles by creating products that release compounds without combustion. Examples of such delivery systems are so-called "heat not burn" products or tobacco heating devices or products, which release compounds by heating, but not burning, a substrate. For example, tobacco heating devices heat an aerosol generating substrate, which may be tobacco or other non-tobacco products which may or may not contain nicotine, to form an aerosol by heating the substrate without burning it.

SUMMARY

According to an aspect of the invention, there is provided a delivery device comprising a housing, a vibration motor for generating haptic feedback to a user, and an elastomeric support member received in the housing, wherein the vibration motor is mounted within the support member.

The elastomeric support member may comprise first and second opposing major faces. The vibration motor may then be received in a recess in said first major face.

The vibration motor can be a press fit in the recess in the first major face.

The delivery device may also include a buzzer for generating audible signals to a user.

The buzzer may be received in another recess in the elastomeric support member.

The recess to receive the buzzer can be in said second major face of the elastomeric support member.

The vibration motor and the buzzer may be positioned side-by-side within the support member.

The vibration motor and the buzzer can be separated by an integral dividing wall within the support member.

The delivery device may comprise a charge circuit board, and the buzzer may be mounted to said charge circuit board.

The elastomeric support member may be made of rubber. The elastomeric support member is preferably made of silicone rubber.

The housing may include an end cap closing an open end of the housing. A battery may be received in the housing. The elastomeric support member can be received in the housing between the battery and the end cap.

The support member may be an interference fit in the housing.

The first major end face of the elastomeric support member can face the battery, and the second major end face of the elastomeric support member can face the end cap.

The elastomeric support member may be at least partially received in the end cap.

The elastomeric support member may be an interference fit in the end cap.

The charge board may be received within, and is preferably attached to, the end cap. The delivery device may comprise a vibration transmission member made from a more rigid material than the support member. The vibration transmission member can be in contact with the vibration motor and an inner wall of the housing.

A portion of the vibration transmission member may overlie an end face of the support member and can be in contact with the vibration motor or a surface of the vibration motor that remains accessible when the vibration motor is received in the support member.

The delivery device may comprise a substrate aerosolising module including a heater and an aerosolisable substrate. The substrate aerosolising module may be configured to aerosolise the substrate in response to a control signal from the control module.

According to a second aspect of the invention, there is provided an assembly for insertion into a housing of a delivery device, The assembly comprises a elastomeric support member having first and second opposing faces, with a recess formed in each face, wherein a vibration motor is received in one recess, and a buzzer is received in the other recess, such that the vibration motor and the buzzer are positioned in side-by-side relationship within the support member.

The vibration motor and the buzzer may be separated from each other by a dividing wall formed by an integral part of the support member.

BRIEF DESCRIPTION OF THE DRAWINGS

Example embodiments will now be described, by way of example only, with reference to the following schematic drawings, in which.

DETAILED DESCRIPTION

As used herein, the term "delivery system" is intended to encompass systems that deliver at least one substance to a user, and includes: non-combustible aerosol provision systems that release compounds from an aerosol-generating material without combusting the aerosol-generating material, such as electronic cigarettes, tobacco heating products, and hybrid systems to generate aerosol using a combination of aerosol-generating materials.

Embodiments according to the invention provide a delivery system that includes a vibration motor to provide haptic feedback to a user in the form of vibrations, similar to that provided in a mobile phone. In certain embodiments, the delivery device also includes a buzzer to generate an audible signal to the user. Each of the vibration motor and the buzzer can be used to provide information to the user of the delivery device such as, for example, whether it is switched on, or its state of charge.

Figure 1:
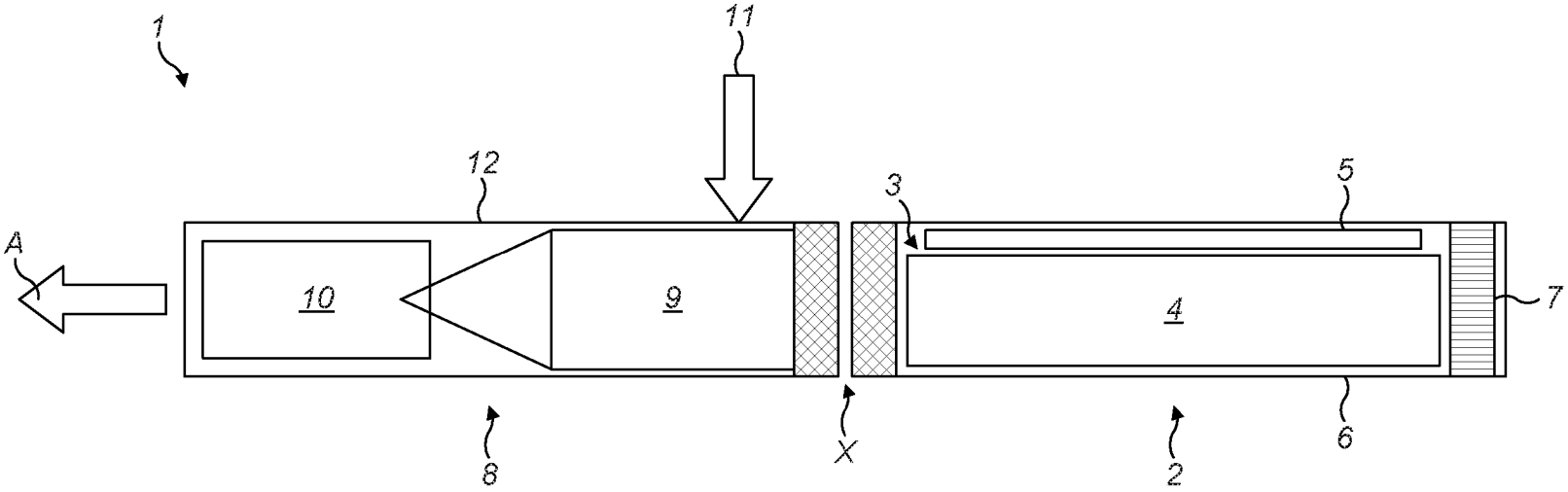
FIG. 1 is a schematic drawing of a device in accordance with an example embodiment.

FIG. 1 is a schematic drawing of a delivery system in the form of a non-combustible aerosol provision device, indicated generally by the reference numeral 1, in accordance with an example embodiment. The device 1 comprises two main components 2, 8.

The first component 2 of the device 1 includes a control module 3, which includes a battery 4 and a circuit board 5. The control module 3 is received within a housing 6 which encloses the control module 3 and forms the external appearance of the device 1. The housing 6 may be a tubular sleeve, in which case the control module 3 is inserted into the housing 6 from one open end during assembly of the device and the open end of the housing 6 is then closed by an end cap 7 so that the housing is closed. However, the housing 6 may, alternatively, be formed from multiple parts or shells that are attached together to form an enclosure around the control module 3. The housing 6 is preferably formed from a metal, such as aluminium, although other materials for the housing 6 are also possible.

The first component 2 includes a connector, such as a USB connector, which may enable connection to be made to a power source for charging the battery 4 of the control module 3. The connector may be accessible through the end cap 7.

The second component 8 of the device 1 includes a heater 9 and a liquid reservoir 10 that may collectively form an aerosol generating module. The first and second components 2, 8 may be modular, i.e. the second component 8 may have its own housing 12 and be separable from the first component 2 (at a join marked X in FIG. 1) for repair or replacement. A releasable electrical connection joins the first and second components 2, 8 to enable power and control signals to be transmitted between them. However, the first and second components 2, 8 may not be separable, other than by disassembly of the device 1. More specifically, the first and second components 2, 8 may be connected together during assembly and received within the same integral housing 6 to form an integral unit.

When the device of FIG. 1 is used, air is drawn into an air inlet of the heater 9, as indicated by the arrow 11. The heater 9 is controlled by the control module 3 and heats the incoming air. The heated air is directed to the liquid reservoir 10, where an aerosol is generated. The aerosol exits the device 1 at an air outlet, as indicated by the arrow A, into the mouth of a user of the device 1.

Figure 2:
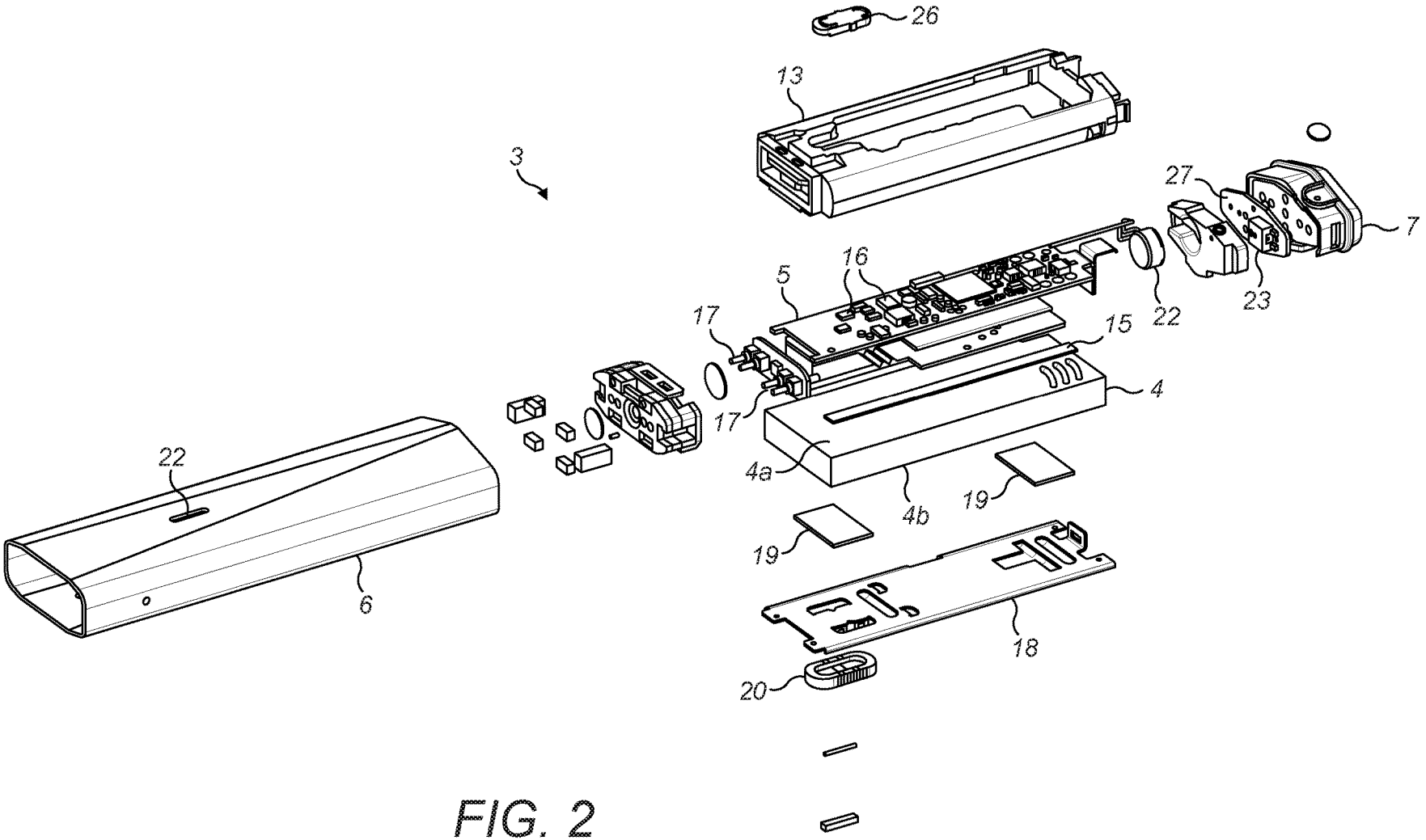
FIG. 2 is an exploded view of a control module of the device shown in FIG. 1.
Figure 3:
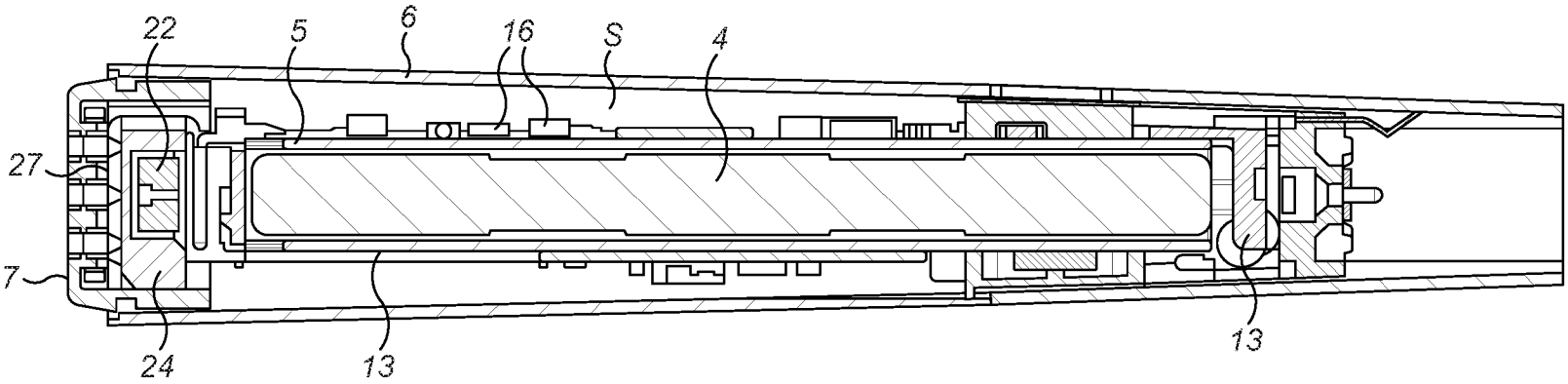
FIG. 3 is a cross-sectional view of the assembled control module of FIG. 2.
Figure 4:
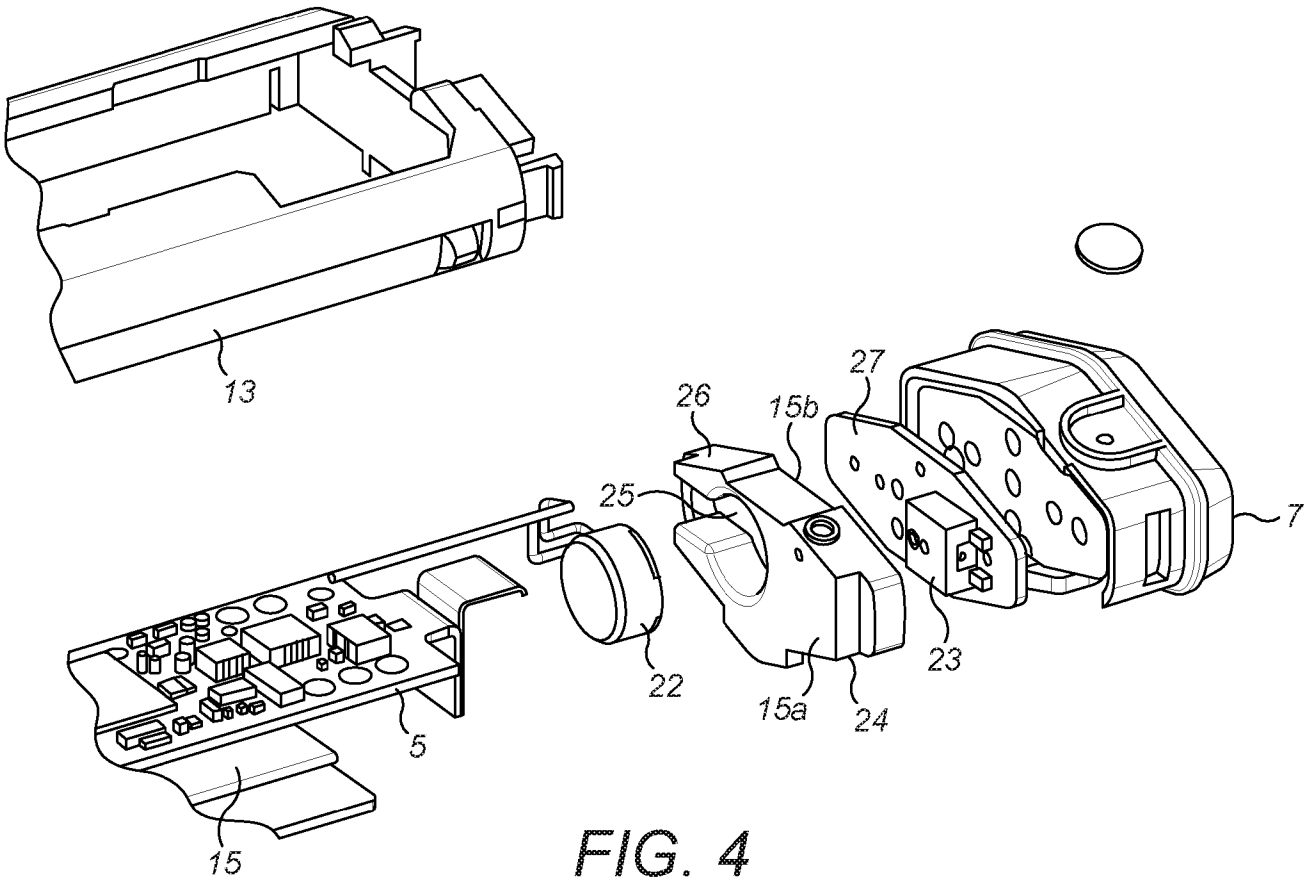
FIG. 4 is a partial enlarged view of the control module of FIG. 2.

FIG. 2 is a more detailed and exploded view of the control module 3 shown in FIG. 1, with the second component 8 omitted, and FIG. 3 is a cross-sectional side elevation of the assembled control module 3 of FIG. 1. FIG. 4 is a partial view of the exploded perspective view of FIG. 2, to show an assembly 14 more clearly. Assembly 14 comprises an elastomeric support member 15 that receives and mounts a vibration motor 22 and, optionally, a buzzer 23.

As shown in FIG. 2, the housing 6 is in the form of a sleeve and the remaining components of the control module 3 are inserted into the housing 6 from one end. The end is then closed by the end cap 7, which can be an interference fit in the housing 6, or be attached to the housing 6 with mechanical fasteners or adhesive.

The control module 3 includes a frame or carrier 13 in which the battery 4 is received and held. A circuit board 5 is mounted to the outside of the carrier 13 and is supported by both the carrier 13 and by the outside of one major face 4*a* of the battery 4. An insulated spacer or adhesive support pad 15 may be located between the major face 4*a* of the battery 4 and the circuit board 5 where they overlie each other. Various electrical circuit and control elements 16 are mounted to the circuit board 5, which also has connectors 17 for electrical connection of the circuit board 5 to the aerosol generating module of the second component 8. These connectors 17 are positioned on a section of the circuit board 5 that overhangs one end of the carrier 13.

A metal or conductive plate 18 is mounted to the carrier 13 and to the other major face 4*b* of the battery 4 on the opposite side of the battery 4 to the circuit board 5. An insulated pad or spacer 19 may be located between the other major face 4*b* of the battery 4 and the metal plate 18 and may be adhesive so that the metal plate 18 is held in place on the other major face 4*b* of the battery 4. The metal plate 18 forms an electrical connection between the battery 4 and the circuit and control elements 16 on the circuit board 5.

The control module 3 includes a press button on/off switch 20, which is mounted to the metal plate 18 and is accessible through an aperture in the housing 6. Pressing the on/off switch 20 connects, or disconnects, the battery 4 from the circuitry 16 on the circuit board 5, thereby switching the device on or off, or performing other control functions as required.

With further reference to FIGS. 2 and 4, the vibration motor 23 is received within the housing 6 between the carrier 13 and the end cap 7. The vibration motor 23 is received within a support member 24 or moulding which is made from an elastomeric material. The support member 24 is preferably made from rubber, and most preferably silicone rubber, and supports the vibration motor 22 and dampens the vibrations generated by the vibration motor 22. The support member 24 has an opening or recess 25 in which the vibration motor 22 is a snug or press fit so that it can be pressed into the recess 25 and held securely within it. The support member 24 has an external shape which corresponds to the inner shape of the housing 6 so that the external surface 26 of the support member 24 lies in contact with the internal surface of the housing 6, or within the cap 7. The support member 24 may be partly received in the cap 7 and extend from the cap 7 into the housing 6. The support member 24 may be a press-fit or interference fit with the cap and/or the housing, so that it is held in a stable condition within the housing 6. Being made from an elastomeric material, the support member 24 may 'give' during assembly to enable it to be inserted into the housing 6 and/or cap 7 so as to be retained firmly therein between the end of the carrier 13 and the end cap 7.

In certain embodiments, a relatively rigid panel may lie in contact with the vibration motor 22 or a part of the vibration motor 22 that remains visible after it is received in its recess 25 in the support member 24. This panel may also be in contact with the inside wall of the housing 6. Vibrations of the vibration motor 22 are then transmitted to the housing 6 via the relatively rigid panel in addition to, of instead of, via the support member 24.

If the delivery device 1 is provided with a buzzer 23, it is mounted to a charge board 27, which controls the charging of the device via a USB cable or suchlike. The charge board 27 is also received in one end of the housing 6 between the carrier 13 and the end cap 7, and is preferably received in the end cap 7 itself. When the buzzer 23 is received in the support member 24, the charge board 27 lies substantially against the major face 15*b* of the support member 24.

The buzzer 23 is preferably also received within the support member 24, and the support member 24 is provided with an additional recess or opening (not shown) to receive the buzzer 23. Similarly to the vibration motor 22, the buzzer 23 may be a press fit into its recess in the support member 24. Preferably, the support member 15 has two opposing major faces 15*a*, 15*b* with the recess 25 for the vibration motor 22 being formed in one face 15*a*, and the recess for the buzzer 23 being formed in the opposing face 15*b*, so that the vibration motor 22 and the buzzer 23 are both protected and remain separated from each other by an internal wall of the support member 24. It will be understood, particularly from FIG. 4, that the vibration motor 22 and the buzzer 23 are offset laterally from each other within the support member 24, i.e. they are in side-by-side orientations, and are separated by an internal central dividing wall of the support member 24. The vibration motor 22 and the buzzer 23 are also inserted into the support member 24 from opposite sides of the support member 24, i.e. the recesses are in opposite faces 15*a*, 15*b* of the support member 24. Each recess is shaped to receive the vibration motor 22 and the buzzer 23, respectively. Therefore, the device is easy to assemble. Furthermore, the support member 24 fits into the housing 6 and/or end cap 7 and is held firm without any additional fasteners.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A delivery device comprising:

a housing, a vibration motor for generating haptic feedback to a user, a buzzer for generating audible signals, and an elastomeric support member received in the housing, wherein the elastomeric support member comprises first and second opposing major faces, wherein the vibration motor is received in a recess in said first major face of the elastomeric support member and the buzzer is received in another recess in the elastomeric support member.

2. A delivery device according to claim 1, wherein the vibration motor is a press fit in the recess in the first major face.

3. A delivery device according to claim 1, wherein the elastomeric support member is made of rubber.

4. A delivery device according to claim 1, comprising a substrate aerosolising module including a heater and an aerosolisable substrate, the substrate aerosolising module being configured to aerosolise the substrate in response to a control signal.

5. A delivery device according to claim 1, wherein the recess to receive the buzzer is in said second major face of the elastomeric support member.

6. A delivery device according to claim 5, wherein the vibration motor and the buzzer are positioned side-by-side within the support member.

7. A delivery device according to claim 6, wherein the vibration motor and the buzzer are separated by an integral dividing wall within the support member.

8. A delivery device according to claim 1, comprising a charge circuit board, wherein the buzzer is mounted to said charge circuit board.

9. A delivery device according to claim 8, wherein the elastomeric support member is made of silicone rubber.

10. A delivery device according to claim 8, wherein the housing includes an end cap closing an open end of the housing, and the charge circuit board is received within, and is attached to, the end cap.

11. A delivery device according to claim 1, wherein the housing includes an end cap closing an open end of the housing, and a battery received in the housing, wherein the elastomeric support member is received in the housing between the battery and the end cap.

12. A delivery device according to claim 11, wherein the support member is an interference fit in the housing.

13. A delivery device according to claim 11, wherein the first major-end face of the elastomeric support member faces the battery, and the second major end face of the elastomeric support member faces the end cap.

14. A delivery device according to claim 11, wherein the elastomeric support member is at least partially received in the end cap.

15. A delivery device according to claim 14, wherein the elastomeric support member is an interference fit in the end cap.

* * * * *